United States Patent [19]

Anderson

[11] 4,262,450

[45] Apr. 21, 1981

[54] BUILDING STRUCTURE

[75] Inventor: Richard N. Anderson, Owensboro, Ky.

[73] Assignee: V. E. Anderson Mfg. Co., Owensboro, Ky.

[21] Appl. No.: 340,556

[22] Filed: Mar. 12, 1973

Related U.S. Application Data

[63] Continuation-in-part of Ser. No. 219,330, Jan. 20, 1972, Pat. No. 3,854,245.

[51] Int. Cl.[3] ..... E05D 13/02; E05D 13/04

[52] U.S. Cl. ..... 49/425; 49/449

[58] Field of Search ..... 49/425, 449

[56] References Cited

U.S. PATENT DOCUMENTS

| | | | |
|---|---|---|---|
| 2,627,092 | 2/1953 | Grossman | 49/423 X |
| 2,952,883 | 9/1960 | Kessler et al. | 49/449 X |
| 3,352,586 | 11/1967 | Hakanson | 292/5 DF |
| 3,395,490 | 8/1968 | Diack | 49/449 |
| 3,640,559 | 2/1972 | Royer | 292/288 |
| 3,698,883 | 10/1972 | DiFazio | 49/449 |

FOREIGN PATENT DOCUMENTS

| | | | |
|---|---|---|---|
| 785705 | 11/1967 | United Kingdom | 49/449 |

*Primary Examiner*—Kenneth Downey
*Attorney, Agent, or Firm*—Whittemore, Hulbert & Belknap

[57] ABSTRACT

Sliding door structure including an outer frame, at least one fixed and one movable door panel, and a screen door, said frame including a head having a single, inwardly extending movable door panel guiding fin and all mitered corners which corners include integral, offset abutment structure for insuring proper alignment of the corners in assembly, improved weather stripping at both the top and bottom rail of both the fixed and movable door panels, bottom adjusting structure for the movable door panel, and two-member glazing structure for the door panels capable of resisting high wind force and permitting glazing of the door panels from the inside. The frame and door panels include substantially universal and reversible members to reduce inventory. Resilient bumpers, a weather stop and prowler lock structure permitting locking of the sliding door structure of the movable door panel in a number of selected positions are also disclosed. The screen is provided with universal and interchangeable upper, side and lower rails which include a unique cross section having a parallelogram recess therein cooperating with spline structure having a similar cross section for securing the edge of a screen to the rails. Unique spring biased, adjustable roller assemblies are provided at the corners of the screen door. Nail fin adapters for the door frame members, both inside and outside trim structure, and an adapter for extending the frame sill are also disclosed.

2 Claims, 42 Drawing Figures

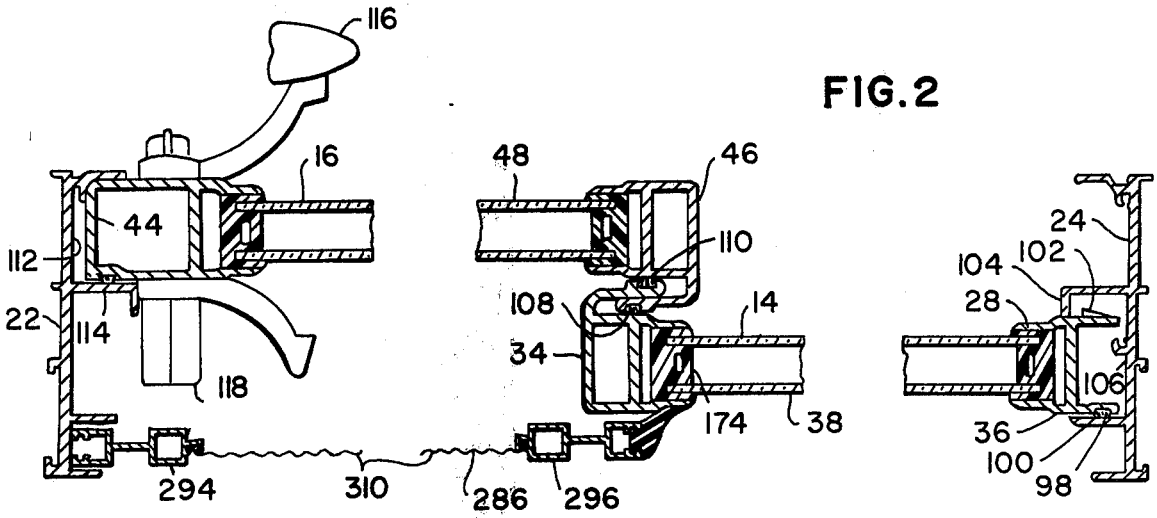
FIG. 2
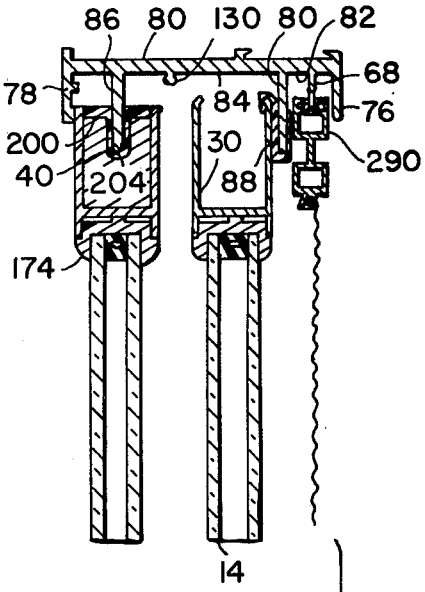
FIG. 4
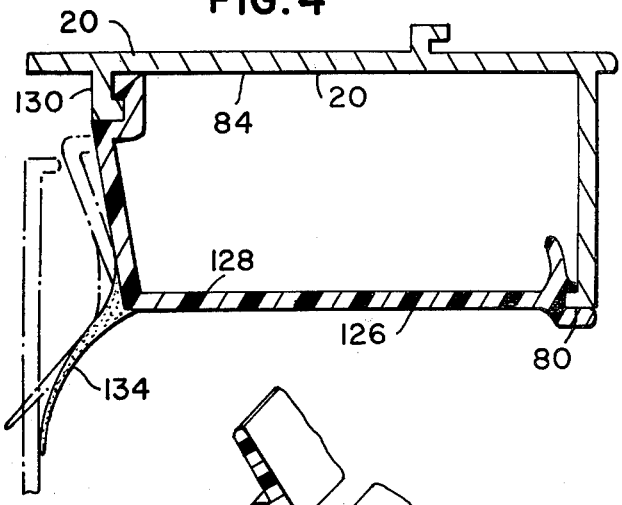
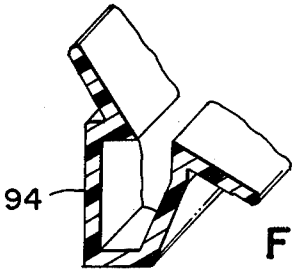
FIG. 5
FIG. 3
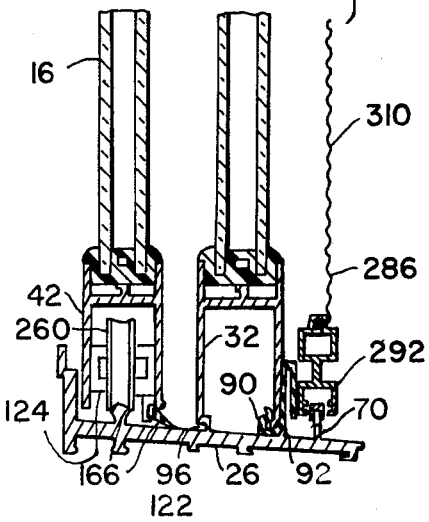
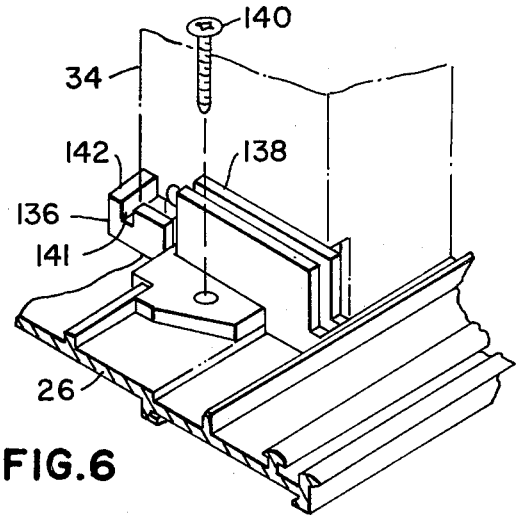
FIG. 6

FIG. 8
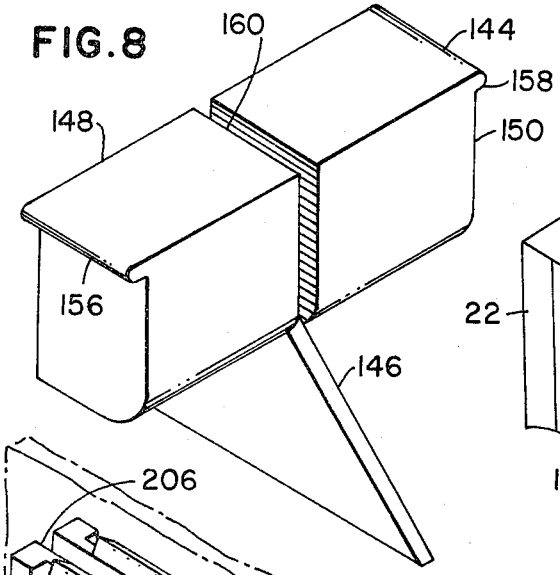
FIG. 7
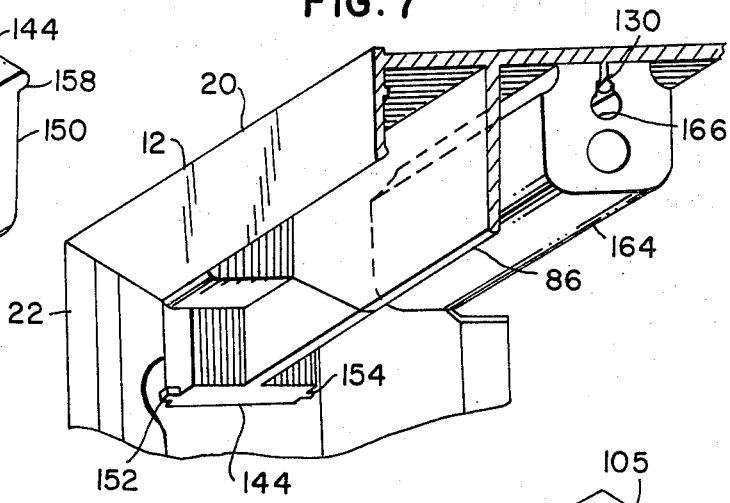
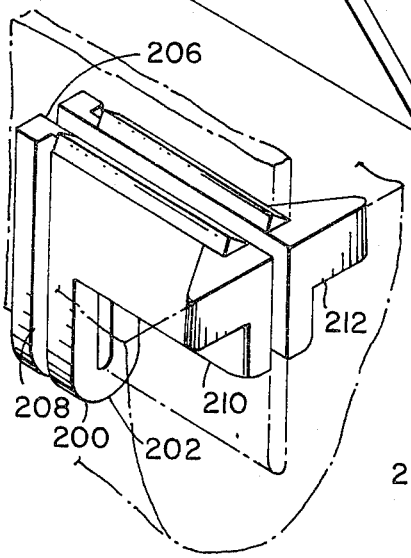
FIG. 10
FIG. 11
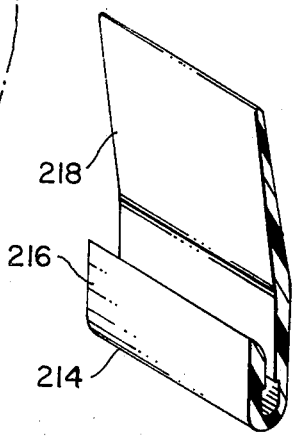
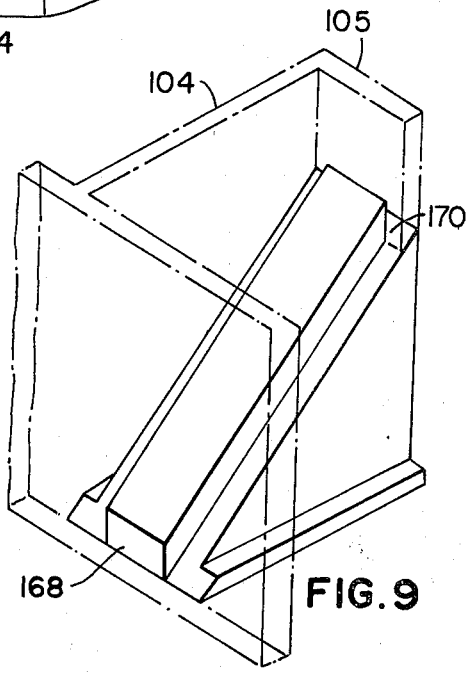
FIG. 9
FIG. 12
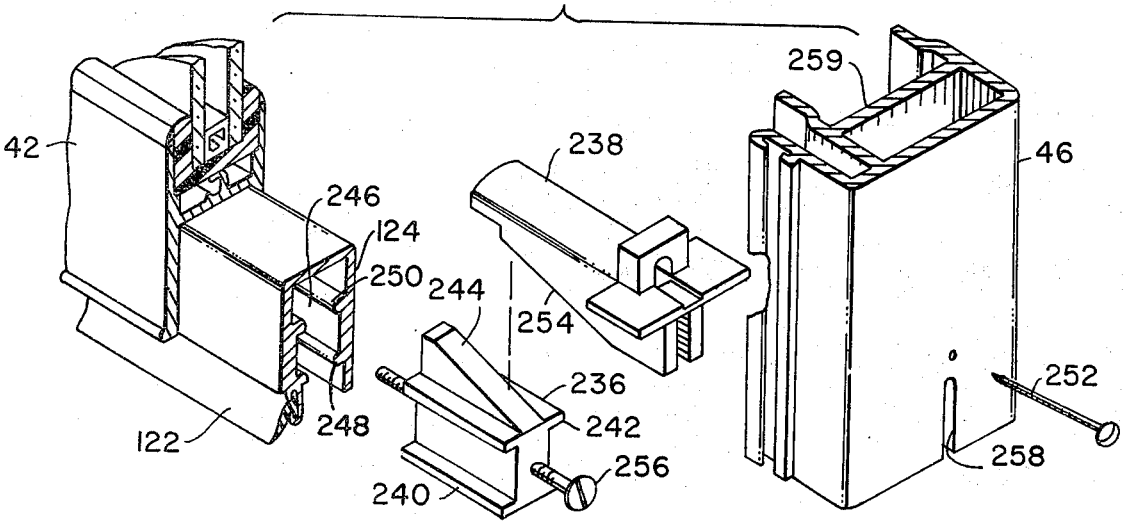

FIG.13
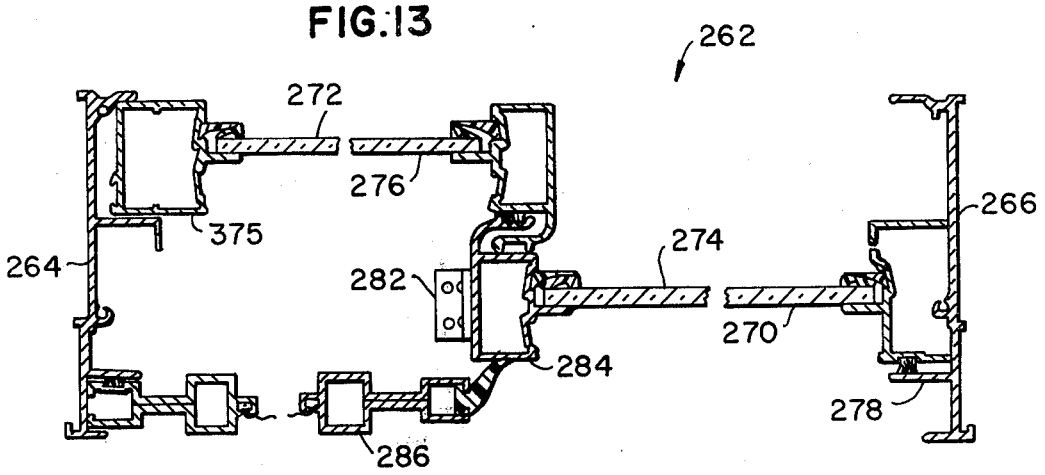
FIG.14
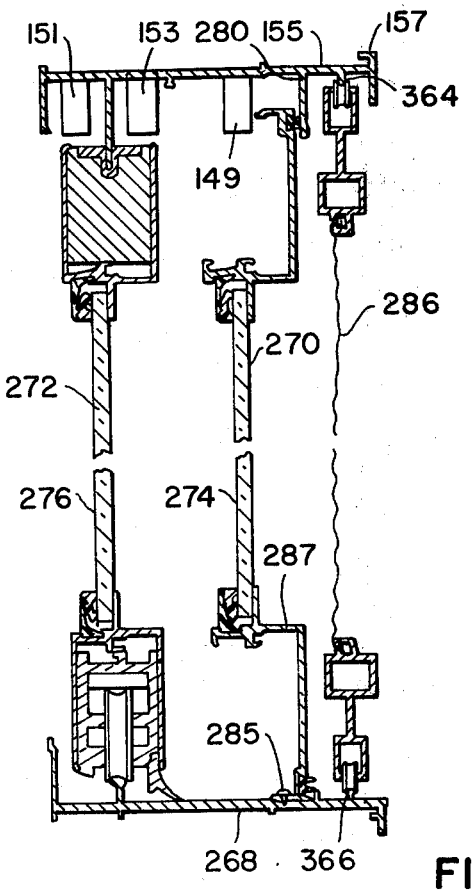
FIG.18
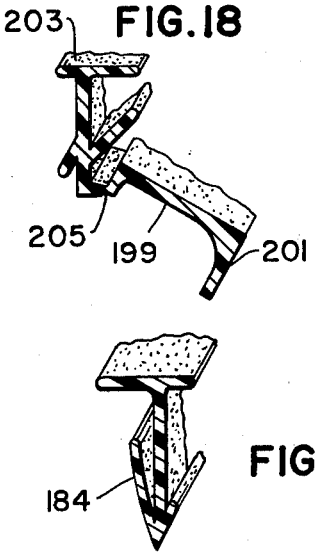
FIG.17
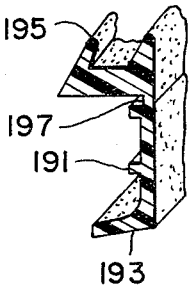
FIG.16
FIG.15
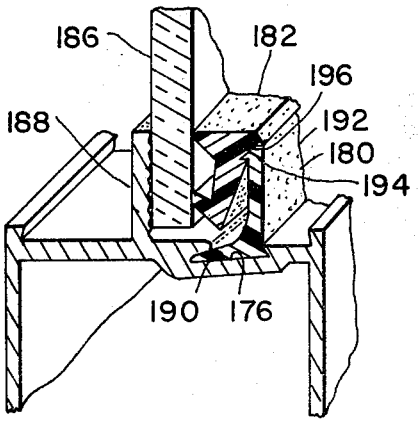

FIG.19
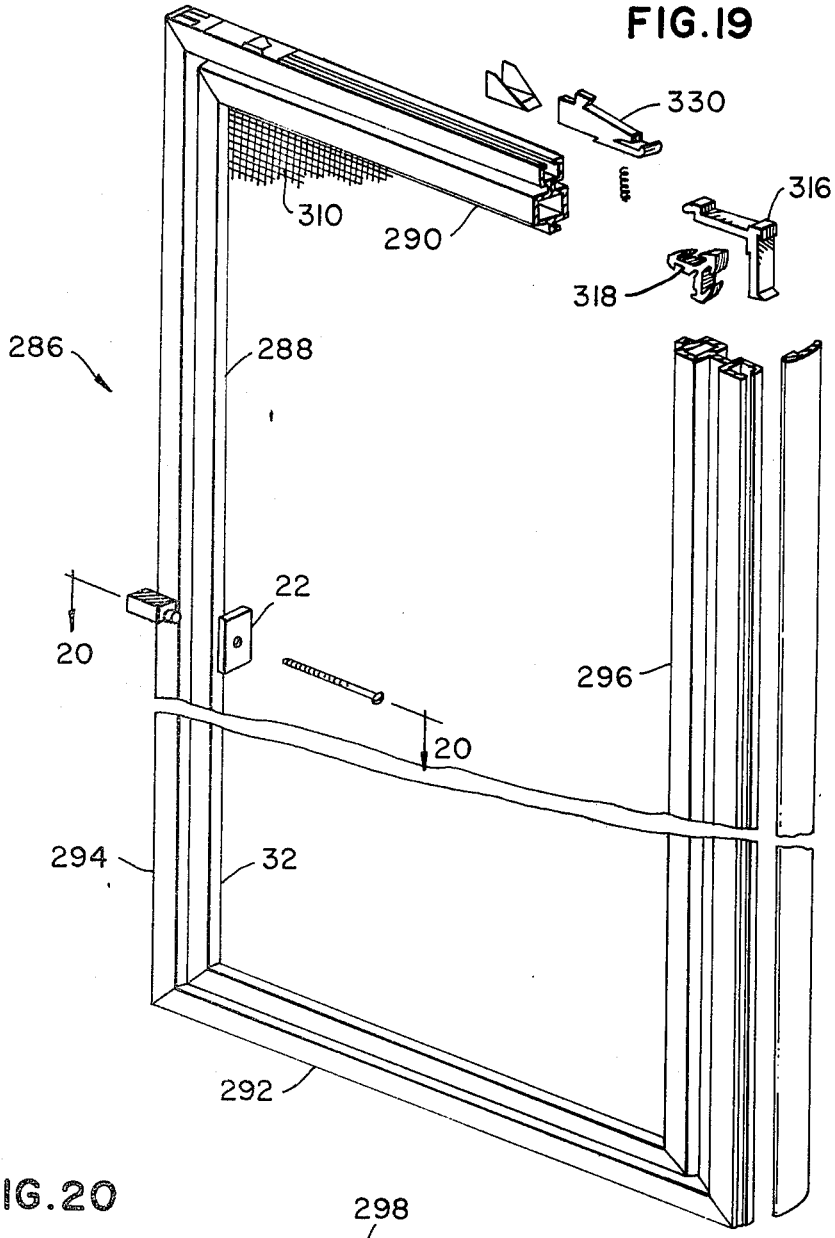
FIG.20
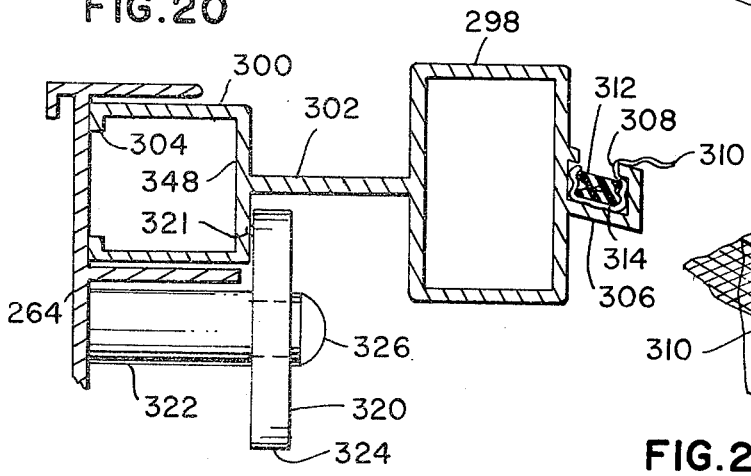
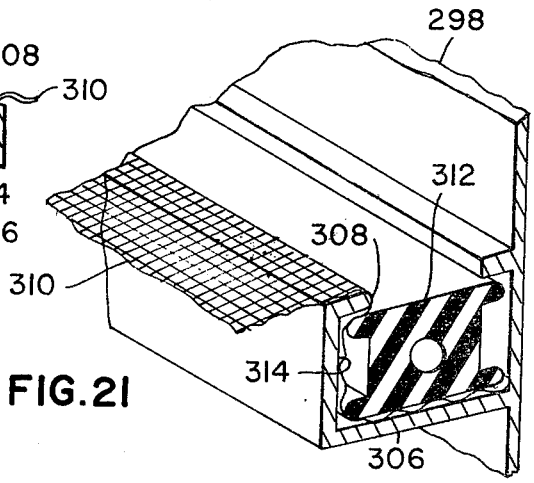
FIG.21

FIG. 26
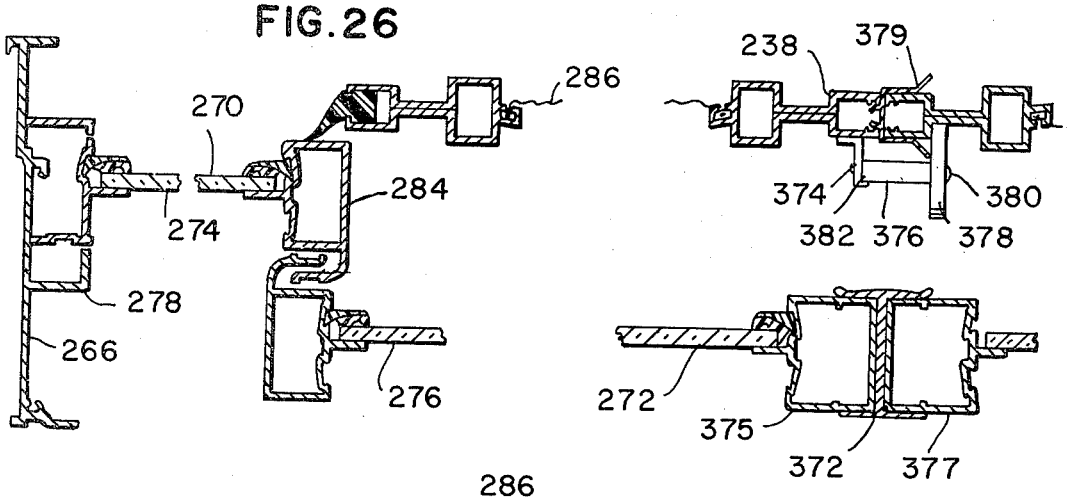
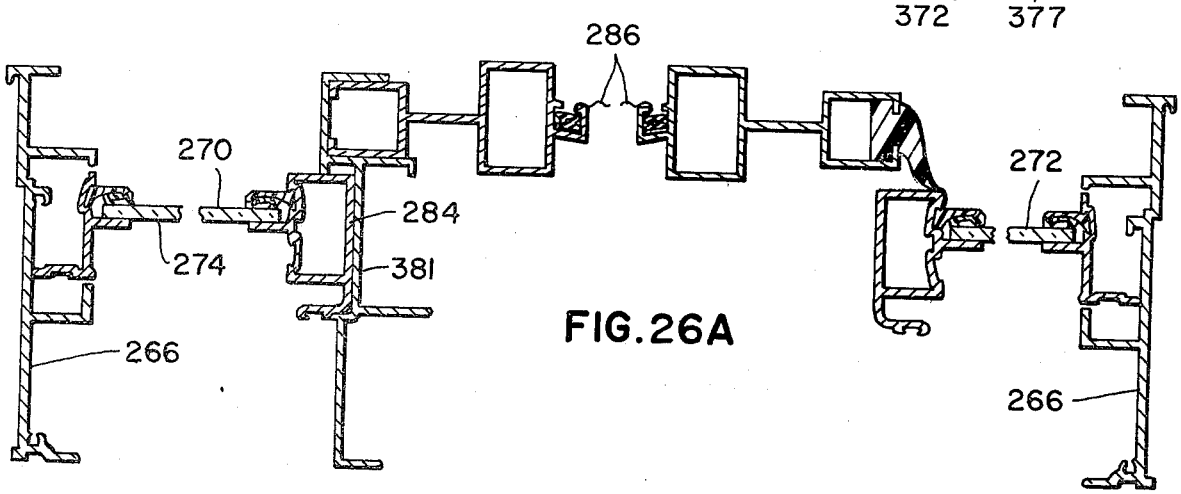
FIG. 26A
FIG. 27
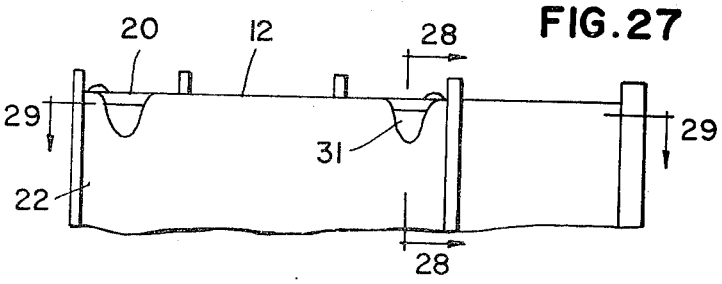
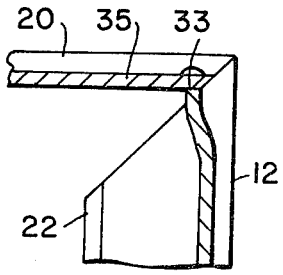
FIG. 28
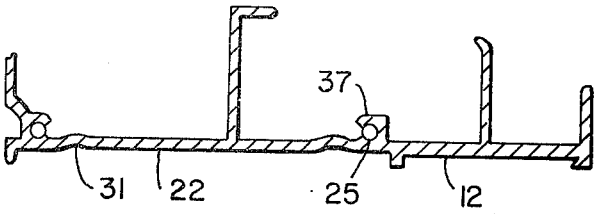
FIG. 29

FIG. 30
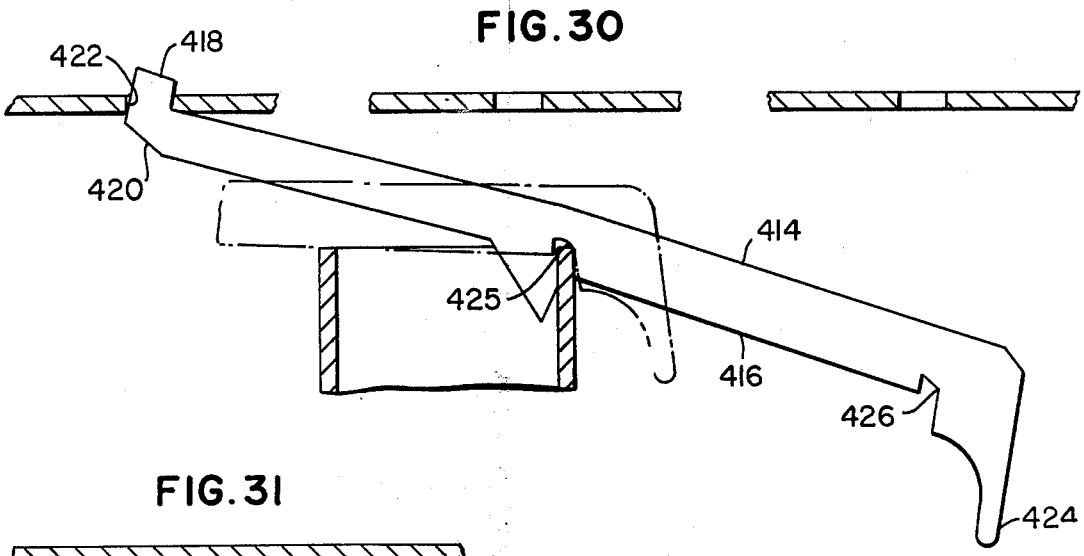
FIG. 31
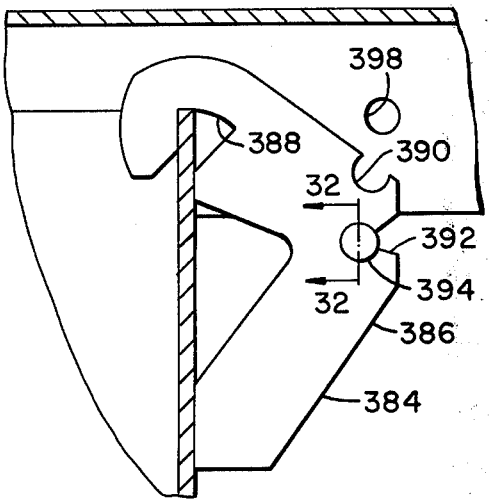
FIG. 33
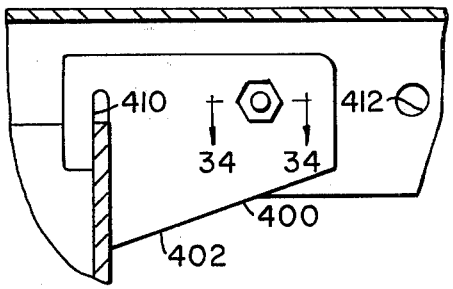
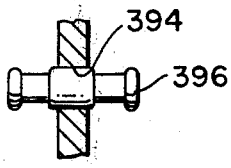
FIG. 32
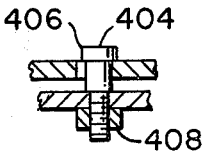
FIG. 34
FIG. 35
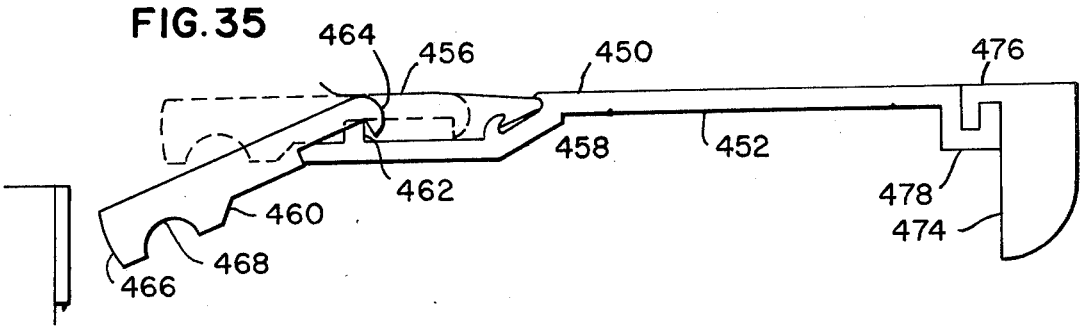

FIG. 36
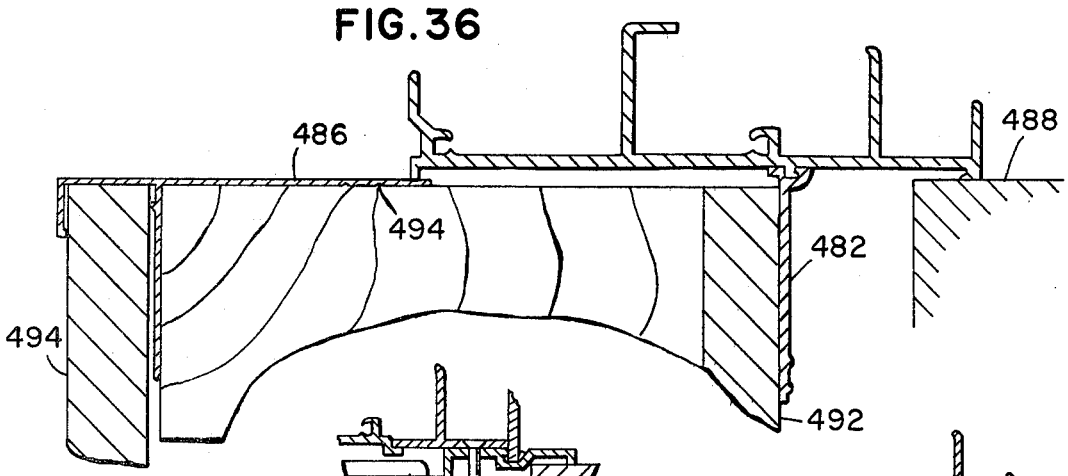
FIG. 41
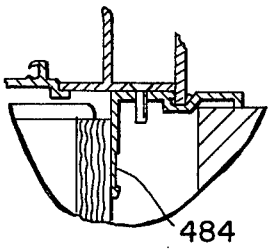
FIG. 37
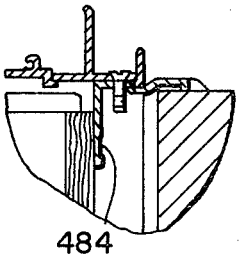
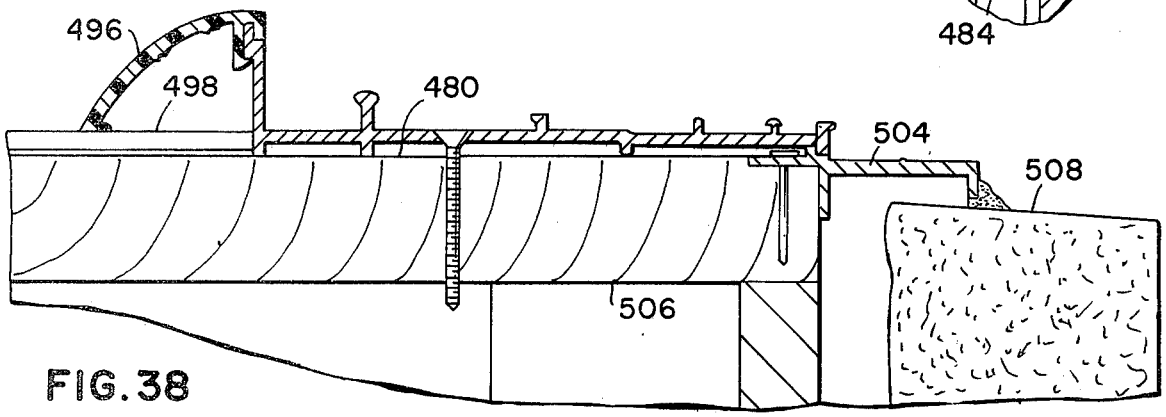
FIG. 38
FIG. 40
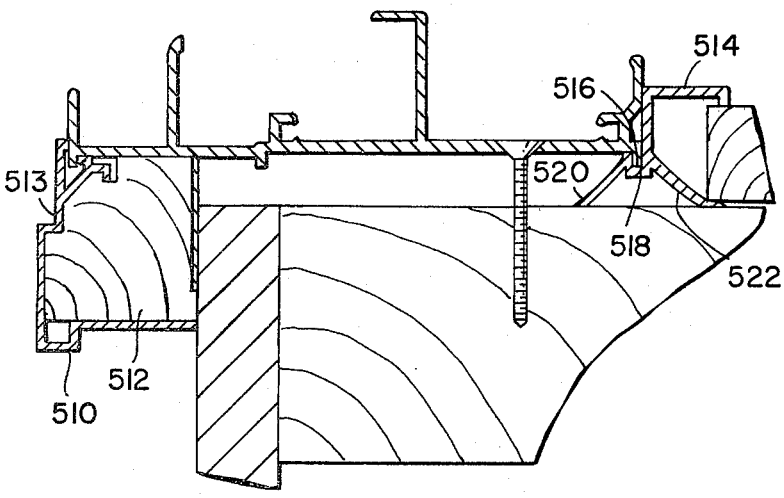
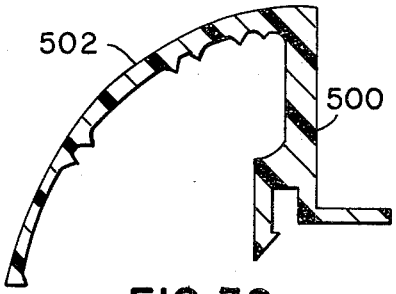
FIG. 39

BUILDING STRUCTURE

CROSS-REFERENCE TO RELATED APPLICATIONS

This application is a continuation-in-part of application Ser. No. 219,330, filed Jan. 20, 1972 now U.S. Pat. No. 3,854,245.

BACKGROUND OF THE INVENTION

1. Field of the Invention

The invention relates to building structures and refers more specifically to a sliding door which is esthetically pleasing, easily operated, has weathertight integrity to both air and water, has extremely high structural integrity and substantial universality of components whereby the greatest degree of versatility has been achieved from a specified inventory investment of raw material and finished goods at a relatively low cost. In one modification, the sliding door has been particularly structured to provide high efficiency and economy by modification of the sliding door frame and door panel extrusions and provision of a screen having an extruded frame with a single cross section and unique hardware.

2. Description of the Prior Art

In the past, sliding doors have not generally included all mitered corners. In particular, the jambs at the bottoms of previous sliding doors have generally either been straight-cut across the sill, or where the sill has been inclined, the jambs have been diagonally cut, whereby a high degree of orientation is given to the frame members of previous sliding doors which is undesirable from an inventory and thus cost point-of-view. Further, wherein mitered corners have been provided in sliding doors in the past, no means have been provided to prevent misalignment of the mitered joints on securing the members forming the mitered joints to each other. Thus, mitered joints in the past have required skilled workmen to produce and have often been misaligned.

In addition, in prior sliding doors, either two pockets formed by three fins, one pocket for each of a movable and fixed door panel with a fin between the door panels, have been provided in the frame head, or alternatively, three pockets have been provided between two outer fins and two intermediate or guide fins in the frame head for guiding the top rails of a movable and a fixed door panel, with the guide fins received in slots in the door panel top rails. In both structures, considerable weather sealing and/or fabrication of weather seal interlocks on the door panels has been necessary. Again, the added weather sealing and fabrication together with the orientation which the fabrication and/or weather sealing require has given the components of and the finished door panels thus constructed has added an undesirable cost factor and inventory requirement to previous sliding doors.

Further, previous sliding doors have usually not been suitably weathertight without expensive and sometimes complicated structure. Thus, for example, a complete aluminum surround has often been provided in the past for glazing sliding door panels from the inside to prevent popping of the glazing panels out of the frame therefor under high wind loads. Complicated structure has sometimes been required to prevent entire sliding door panels from being blown out of the outer frame therefor.

In addition, with prior sliding doors, stopping of the sliding door on opening has sometimes been a problem. Wherein stops have been provided only at the tops or bottoms of the movable door panel, the door panel tends to cock in the frame on hitting the stop, thus wearing door panel rollers and damaging the outer frame or movable door panel. Prior stop structures have an addition also required separate fabrication of the frame member to install and sometimes themselves have been complicated and therefore expensive. Central stops have in general not been utilized due to their appearance and the fact that they tend to damage the door and/or frame members due to single-point contact therewith centrally thereof.

Further, with prior sliding doors it has often been possible on jiggling the movable door panel to unlock it and to gain entrance into the building in which the doors have been installed. It has generally been impossible with sliding doors to lock the movable door panel in a partly open position to provide, for example, ventilation without allowing small children to go out or prowlers to come in the doors.

Also, it has been difficult in the field, with the size of sliding doors usually installed today, to obtain square structural openings for the sliding door structures. It has therefore been necessary to adjust the movable door panel of sliding doors to compensate for the out-of-square door openings. In the past, such adjustment has usually been accomplished by adjusting the movable door panel at both sides thereof, which requires separate adjusting mechanisms and separate adjustments which are not entirely independent at both sides of the movable door panels.

The sliding screen doors provided with the sliding door structures of the past have usually had roll formed frames and have been required to have deep pockets in the upper and lower frame rails to receive adjustable rollers at the corners of the screen doors. The frame members have therefore often been of different cross section and have not always been provided with mitered corners. In addition, in the past, screen members have been secured to the frames in rectangular recesses receiving either round or rectangular splines. Such structure has not always securely held the periphery of the screen to the frame. Separate handle and locking structures have usually been provided with prior sliding screen doors.

Further, in the past, sliding doors have not always been adapted for installation in a wide variety of building structures with a single frame, as for example, building structures which require nailing fins for securing the frame to the exterior of the building structure. In addition, neither interior nor exterior trim for sliding doors have normally been readily available and extensions of sliding door frame sills have in the past generally been field fabricated.

SUMMARY OF THE INVENTION

In accordance with the present invention, there is provided a sliding door including an outer frame having four mitered corners and a plurality of door panels, at least one of which may be fixed and one of which is movable, which outer frame and door panels and the individual members thereof have been constructed with a minimum of orientation to provide the greatest degree of versatility from a specified inventory investment for both raw and finished goods. Thus, wherever possible the members of the sliding door structure of the invention are interchangeable right-left, up-down, inside and outside.

In one modification of the preferred embodiment of the invention, the members of the frame and door panels have been constructed to provide a cross section which is efficient yet particularly economical.

The mitered corners of the outer frame are provided with integral offset abutment structure on one member thereof adapted to engage the other member forming the corner, whereby the corners may be quickly and accurately aligned in assembly and tightly connected without the danger of misalignment on drawing the miter-cut members tightly against each other.

The head of the outer frame of the sliding door structure disclosed is provided with a single guide fin for guiding a movable door panel and no fin is positioned between the movable door panel and the fixed door panel, whereby weather sealing of the door panels is particularly simple and efficient. Hairpin shaped top guide members are provided between the top of the movable door panels and guide fins. Unique weather seals are provided at both the upper and lower rails of both the movable and fixed panels of the sliding door structure which also aid in maintaining the structural integrity of the sliding door.

Further, in one modification of the preferred embodiment, the fixed door panel of the slidng door structure of the invention is retained at its fixed side rail in assembly with a jamb of the outer frame by staked-out portions therein. The other or free side rail of the fixed door panel of the sliding door structure may be secured to the sill by a weather stop bracket to enable the sliding door structure to withstand very high winds.

In another modification of the sliding door structure of the invention, the fixed door panel may be retained at its fixed side rail in assembly with a jamb of the outer frame by screws extending through the jamb of the frame and into the fixed side rail of the fixed door panel. In either modification, the top rail of the fixed door panel may be secured to the head of the outer frame by screws.

Further, a two-member glazing system is provided for the door panels in one modification of the preferred embodiment of the invention which enable the glazing panels to withstand very high wind pressures and permit glazing of the door panels from the inside of a building in which the sliding door is installed.

A unique bumper system is provided for the sliding door structure including a resilient bumper at both the head and sill of the frame engageable with the sliding door panel which require no fabrication of the sliding door structure. In addition, prowler security means are provided at the upper corners of the sliding door structure which prevents upward jiggling of the movable panel and consequent unauthorized unlocking thereof along with weather stops at all four mitered corners of the sliding doors, which weather stops also serve to align the mitered corners in field assembly. Separate prowler lock structure and modifications thereof are also provided to permit securing the movable panel of the sliding door structure in any of a plurality of closed and partly open positions.

To compensate for out-of-square door openings in installation, the movable panel of the sliding door is positioned on an expander and a wedge and a wedge block are secured to the expander and to one edge of the movable panel of the sliding door structure respectively, having engaged, inclined plane surfaces for pivoting the movable panel in the plane of the movable door panel about one edge thereof. The wedge is constructed to fit within the expander at two different levels to provide coarse movable panel adjustment. Fine adjustment of the panel is produced by relative movement of the wedge and wedge block. Wedge and wedge blocks may be provided at one or both edges of the movable door panel.

In a more economical modification of the preferred embodiment of the sliding door structure, the screen frame members are extrusions and are provided with unique spring loaded adjustable roller assemblies at all four corners thereof which do not require deep upper and lower rail cross sections. The screen frame extrusions of this modification are also constructed to eliminate the necessity of separate screen handles and to facilitate locking of the screen to the sliding door structure outer frame by particularly simple lock structure and to receive the periphery of the screen member in a recess having the cross section shape of a parallelogram, which recess is operable in conjunction with a similarly shaped spline to more securely hold the periphery of the screen member. Such screen door structure has universal application and is not therefore limited to the sliding door modification shown herein.

The sliding door structure of the invention is completed with a nailing fin adapter for securing the outer frame in building openings requiring nailing fins. Inside trim extrusions such as resilient bullnose sections adapted to accommodate flooring of different thickness, and exterior trim members including members having a soft core and harder exterior skin are also provided for use in conjunction with the sliding door structure, along with a sill adapter for extending the width of the sill of the outer frame of the sliding door structure. In sliding door structure having two movable door panels, a universal astragal adapter is secured to the locking rail of one movable door panel for receiving the locking rail of the other movable door panel with the movable door panels in a closed position. With three-panel sliding door structure, an astragal adapter is provided between the locking rail of the movable door panel and the free rail of one of the fixed door panels.

BRIEF DESCRIPTION OF THE DRAWINGS

FIG. 2 is an enlarged, broken section view of the sliding door structure illustrated in FIG. 1, taken substantially on the line 2—2 in FIG. 1.

FIG. 3 is an enlarged, broken section view of the sliding door structure illustrated in FIG. 1, taken substantially on the line 3—3 in FIG. 1.

FIG. 4 is an enlarged, partial section view of the door structure illustrated in FIG. 1, taken substantially on the line 4—4 in FIG. 1.

FIG. 5 is an enlarged, perspective view of a portion of an alternate sealing member for use between the bottom rail of the fixed door panel and the frame sill of the sliding door structure illustrated in FIG. 1.

FIG. 6 is an enlarged, perspective view of a portion of the frame sill of the sliding door structure illustrated in FIG. 1, including a weather stop in assembly therewith and showing the free side rail of the fixed door panel of the sliding door structure in assembly therewith in phantom.

FIG. 7 is an enlarged, partial perspective view of one upper corner of the sliding door structure illustrated in FIG. 1, illustrating a flexible bumper for the movable door panel and a weather stop and prowler security member installed at the head of the sliding door frame.

FIG. 8 is an enlarged, perspective view of the weather stop and prowler security member shown in FIG. 7.

FIG. 9 is an enlarged, perspective view of a weather stop member also used for aligning the bottom of the mitered jambs of the outer frame illustrated in assembly with the lower end of a frame jamb which is shown in phantom.

FIG. 10 is an enlarged, perspective view of a sliding door moving panel top guide with the guiding flange of the frame head illustrated in phantom in assembly therewith.

FIG. 11 is a perspective view of a top guide member for the movable sliding door panel.

FIG. 12 is an enlarged, exploded, perspective view of the structure for use in adjusting the movable door panel of the sliding door structure illustrated in FIG. 1 to compensate for out-of-square building openings including a perspective view of a wedge adapted to fit into the expander inserted in the movable door panel bottom rail and a perspective view of a wedge block adapted to fit into the side rail of the movable door panel in engagement with the wedge.

FIG. 13 is a broken section view of a second modification of the preferred embodiment of the invention which is similar to the section view of FIG. 2, which second modification is particularly economical in the outer frame of both the movable and fixed door panels.

FIG. 14 is a broken section view of the second modification of the preferred embodiment of the sliding door structure of the invention as shown in FIG. 13 similar to the section view of FIG. 3.

FIG. 15 is an enlarged, partial perspective view of a two-member glazing system for use in the sliding door structure of the invention as particularly illustrated in FIGS. 13 and 14.

FIG. 16 is an enlarged, partial perspective view of one of the two glazing members illustrated in FIG. 15 showing an alternative cross section therefor.

FIG. 17 is an enlarged, partial perspective view of a dual durometer, single extrusion modification of the two glazing members illustrated in FIG. 15.

FIG. 18 is an enlarged, partial perspective view of a two-part rigid vinyl embodiment of the two glazing members illustrated in FIG. 15.

FIG. 19 is an exploded, perspective view of sliding door screen structure constructed in accordance with the invention.

FIG. 20 is an enlarged, section view of the screen structure illustrated in FIG. 19, taken substantially on the line 20—20 in FIG. 19.

FIG. 21 is an enlarged, perspective view of the spline recess and spline of the screen structure illustrated in FIG. 19.

FIG. 26 is a partial section view through sliding door structure such as that illustrated in FIGS. 13 and 14, showing a four-panel construction including a moving panel astragal adapter and screen locking structure.

FIG. 27 is an enlarged side view of the mitered left hand upper corner of the left-hand upper corner of the outer frame of the sliding door structure of the invention.

FIG. 28 is a partial section view of the mitered upper corner of the outer frame illustrated in FIG. 27, taken substantially on the line 28—28 in FIG. 27.

FIG. 29 is a partial section view of the mitered upper corner of the outer frame of the sliding door structure, taken substantially on the line 29—29 in FIG. 27.

FIG. 30 is an enlarged, elevation view of prowler lock structure for use in the sliding door structure of the invention.

FIG. 31 is an enlarged, elevation view of a modification of prowler lock structure for use in the sliding door structure of the invention.

FIG. 32 is a partial section view of the prowler lock structure illustrated in FIG. 31, taken substantially on the line 32—32 in FIG. 31.

FIG. 33 is an enlarged, partial section view of still another embodiment of prowler lock structure for use in the sliding door structure of the invention.

FIG. 34 is a partial section view of the prowler lock structure illustrated in FIG. 33, taken substantially on the line 34—34 in FIG. 33.

FIG. 35 is an enlarged, elevation view of an additional prowler lock structure for use in the sliding door structure of the invention.

FIG. 36 is an enlarged, section view of a jamb of the outer frame of the sliding door structure of the invention, showing a nailing fin adapter and an inside trim extrusion in assembly therewith.

FIGS. 37 and 41 are a reduced portion of FIG. 36, showing a modified nailing strip between the frame jamb and brick exterior construction.

FIG. 38 is an enlarged, section view of the sill extrusion of the sliding door structure frame, showing a sill extender extrusion in assembly therewith and illustrating a flexible bullnose interior molding in assembly therewith.

FIG. 39 is a section view of a modified, flexible, bullnose interior trim extrusion for use with the door structure of the invention.

FIG. 40 is another enlarged, section view of a jamb of the outer frame of the sliding door structure of the invention, showing an exterior trim member in assembly therewith, including a soft core having an extruded, tougher skin thereon and showing another embodiment of an inside trim extrusion in assembly therewith.

DESCRIPTION OF THE PREFERRED EMBODIMENT

Figure 1:
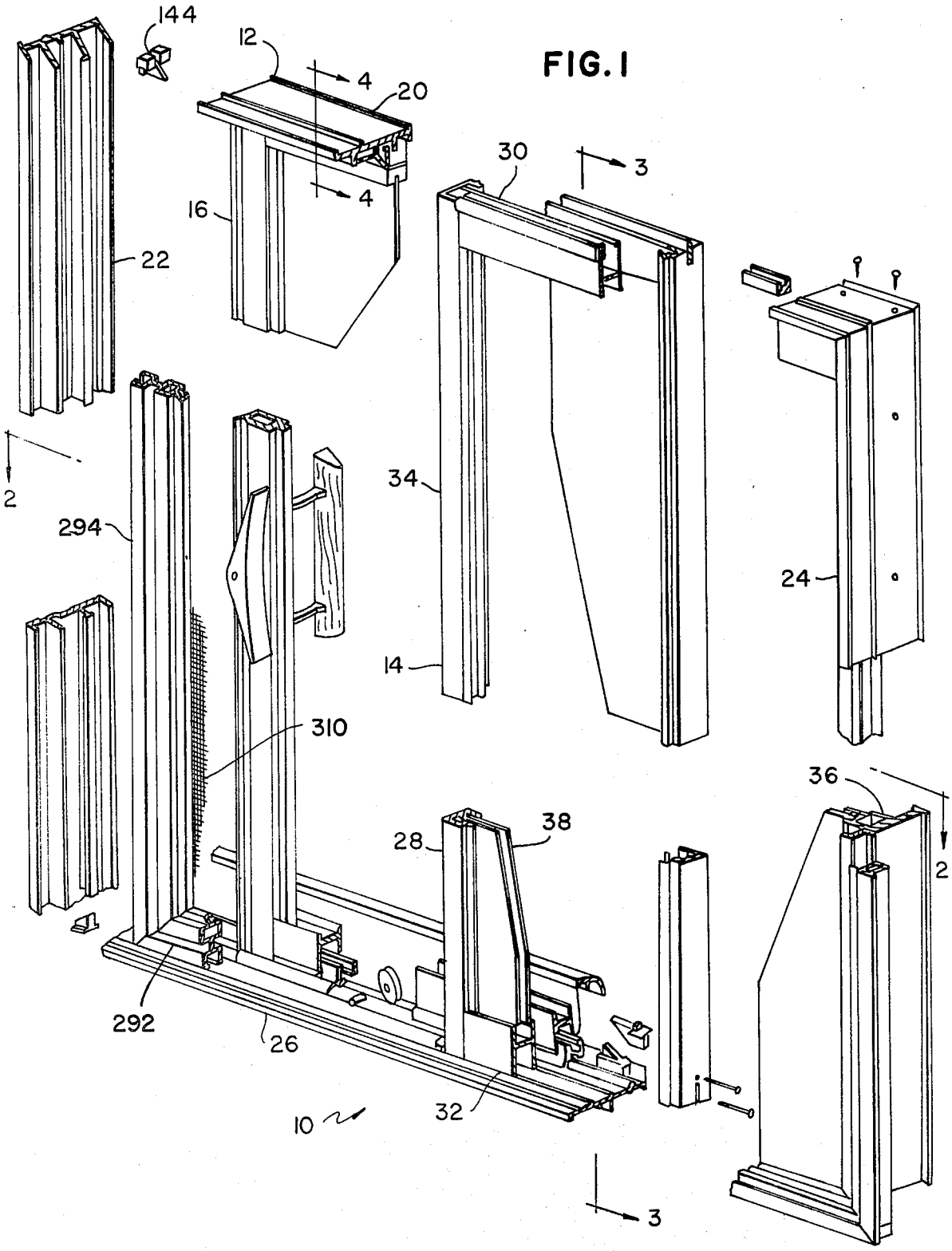
FIG. 1 is a partly broken away and exploded perspective view of one modification of the preferred embodiment of sliding door structure constructed in accordance with the invention.

The first modification of the preferred embodiment of the sliding door structure 10 shown in FIG. 1 includes an outer frame 12, a fixed door panel 14, a movable door panel 16 and a movable screen panel 286. The sliding door structure 10 may have a plurality of fixed and/or moving door panels. Thus, the invention is not intended to be limited to sliding doors having a single fixed door panel and a single movable door panel.

As shown, the outer frame 12 includes a head extrusion 20, jamb extrusions 22 and 24 at opposite sides of the sliding door structure 10 and a sill extrusion 26, which extrusions have the cross sections best shown in FIGS. 2 and 3. Each of the four corners of the outer frame 12 are mitered as shown in FIGS. 27 through 29 and may be held together by suitable screw means 25. With all four corners being mitered, the jambs are universal in that they have no left, right, up or down orientation.

To aid in securing the mitered corners of the frame 12 together in the desired alignment, one or more portions 31 of the jambs 22 and 24 at the ends thereof are offset or depressed as shown best in FIG. 28 to provide an end abutment 33 against which the side of the web 35 of the head 20 and a similar portion of the sill 26 are urged by the screw means 25 extending into the screw runners 37 in the jambs 22 and 24 in assembly of the frame 12. With such structure, the mitered members at the four corners are not permitted to slip past each other along the miter joint as might otherwise happen if the securing screw means 25 were drawn too tight. The mitered corners of the frame 12 may thus be accurately constructed by relatively unskilled workmen. It will be understood that the miter joint aligning concept embodied in the abutting portions formed in the jambs is not limited to extrusion structures.

The fixed door panel 14 includes a fixed door panel frame 28 having a top rail 30, a bottom rail 32 and free and fixed side rails 34 and 36 respectively, again having the cross section shown best in FIGS. 2 and 3. The side rails 34 and 36 extend the entire length of the fixed door panel as shown best in FIG. 1 and are secured to the top and bottom rails 30 and 32 at opposite ends thereof by suitable means such as screws or the like. A glazing panel 38 is secured in the fixed door panel frame 28. Each of the top, bottom and side rails of the fixed door panel 14 is also substantially universal in that they have as little orientation as possible so that the complete panel 14 as well as the individual members thereof may be used for different sliding door configurations.

The sliding door panel 16 includes a top rail 40, a bottom rail 42 and locking and free side rails 44 and 46, respectively. Also as before, the side rails 44 and 46 extend the full length of the movable door panel 16 and are connected to the top rail 40 and bottom rail 42 at the opposite ends thereof as shown best in FIG. 1. The glazing panel 48 is secured in the movable door panel 16 as before and all of the members of the movable panel 16 are constructed without particular orientation when possible so as to be interchangeable.

Thus, the sliding door structure 10 may be constructed in a great number of configurations with a minimum of separate parts such as frame jambs and panel rails and the like, and a complete inventory of sliding doors may be stocked, again with a minimum of separate sliding door elements such as exterior frames, fixed and moving panels. The cost of a sliding door inventory and production equipment and facilities is thus reduced.

The head 20 of the door frame 12 has a cross section shown best in FIG. 3 which includes an outer fin 76 and an inner fin 78 which are only outside and inside trim in the door structure 10. A fin 80 which is a seal for the fixed door panel 14 is positioned between the outer fin 76 and the inner fin 78 and separates the pocket 82 in which the screen panel 18 is received and the pocket 84 in which the top rails 30 and 40 of the fixed door panel 14 and the movable door panel 16 are positioned. A guiding fin 86 is further provided in the pocket 84 for guiding the movable door panel 16 within the frame 12.

Since the head 20 does not include a separate fin positioned between the top rails 30 and 40 of the fixed and movable door panels, no special fabrication of the interlocking portions of free side rails 34 and 46 is required and removable interlocking portions to facilitate universal orientation of the free side rails is not required. Similarly, since only the movable door panel 16 is provided with a guiding fin 86, special weather stripping to prevent the passage of wind and water through the door structure 10 between the head 20 and the top rails 30 and 40 is minimized and uncomplicated.

Thus, the fixed door panel 14 is provided with an elongated sealing member 88 at the top rail 30 having the cross section shown best in FIG. 3. The sealing member 88 performs the dual function of providing structural integrity at the top of the fixed door panel 14 between the head 20 and the top rail 30 and seals the top of the fixed door panel. As shown, the sealing member 88 has a generally S-shaped cross section configuration, one portion of which fits over the top of one side portion of the top rail 30 and the other portion of which fits over the bottom of the head fin 80. An identical sealing member 90 is provided at the bottom rail of the fixed door panel 14 and as shown best in FIG. 3 includes a portion fitting over one side portion of the bottom of the bottom rail 32 of the fixed door panel 14 and another portion fitting over the rib 92 on the frame sill 26. Again, the sealing member 90 provides structural integrity between the frame 12 and fixed door panel 14 at the same time that it provides a seal for the sliding door structure 10.

Alternatively, the sealing member 94 illustrated best in FIG. 5 may be used in place of the sealing member 90. When the sealing member 94 is used, the structural integrity of the fixed door panel 14 at the bottom is provided primarily by the weight of the door panel 14 resting on the sill 26 between the ribs 92 and 96. The member 94 functions primarily as a weather seal.

The sealing of the fixed door panel 14 between the fixed side rail 36 and the frame jamb 24 is accomplished by means of a flexible sealing strip 98 which may be of vinyl, felt or the like in contact with the fin 100 of the frame jamb 24 as shown best in FIG. 2. In addition, the structural integrity of the side rail 36 with the jamb 24 is maintained by the staked-out portions 102 of the side rail 36 fitting behind the returned end portion of the fin 104 of the jamb 24. If desired, the side rail 36 may be secured to the jamb 24 by separate screws, clips or the like in keeping with present conventional construction.

In assembly, the sealing members 88 and 90 or 94 are positioned on the fixed door panel 14 and the door panel 14 is positioned in the frame 12 by first placing the fin 80 in the seal 88 and pivoting the fixed door panel 14 inwardly of the frame 12 at the bottom while moving the fixed door panel 14 upward so that the bottom rail 32 clears the track 70 and rib 92. When the door panel 14 is thus positioned in the frame 12, the door panel 14 is allowed to drop vertically slightly to position the seal 90 or 94 over the rib 92.

The fixed door panel 14 is then moved toward the frame jamb 24 to cam the staked-out portions 102 of the side rail 36 of the fixed door panel 14 into the jamb pocket 106, whereby the sealing strip 98 is positioned in contact with the fin 100 of the jamb 24 and the fixed rail 36 is locked in assembly with the jamb 24. Removal of the fixed door panel 14 then requires the placing of a screwdriver or the like between the fin 104 and rail 36 to spring the fin 104 and permit the staked-out portions 102 of the rail 36 to be removed from the jamb 24. Such removal of the fixed door panel can only be accomplished from the inside of the door.

The fixed door panel 14 and the movable door panel 16 are sealed at the interlocking portions of the free side rails thereof by the flexible strips 108 and 110 positioned in the side rails 34 and 46 as shown best in FIG. 2. Similarly, the locking side rail 44 of the movable door panel is sealed in the pocket 112 of frame jamb 22 with the movable door panel 16 in a closed position by the flexible strip 114. Strips 108, 110 and 114 may be vinyl, felt or similar material. As shown, a suitable handle 116 and lock structure 118 are also secured to the locking side rail 44 of the movable door panel 16 and the frame jamb 22.

The bottom of the movable door panel 16 is sealed by a sealing member 122 having a cross section illustrated best in FIG. 3 and extending from the side of the movable door panel expander 124, which will be considered subsequently. It will be noted that the sealing member 122 extends toward the outside side of the sliding door structure 10 whereby wind pressure on the door structure 10 increases the seal provided by the sealing member 122.

The top rail 40 of the movable door panel 16 is provided with a weather seal by the dual durometer sealing member 126, the cross section of which is shown best in FIG. 4. The portion 128 of the sealing member 126 is of relatively rigid plastic which is flexible enough to be snapped in place over the rib 130 on the head 20 of the frame 12, with the opposite end thereof being constructed to cam over and receive the end of the fin 80 of the head 20. Thus, the sealing member 126 may be positioned within the pocket 84 in the head 20 of the frame 12. With the sealing member 126 so positioned, the softer, more pliable portion 134 of the sealing member wipes against the upper rail 40 of the movable door panel 16 to provide a seal therefor.

Thus, both the fixed door panel 14 and the movable door panel 16 are completely sealed around their entire periphery when the movable door panel is closed, with a minimum number of simple sealing members. In addition, the sealing system does not orient any of the frame or door panel members so that they are again as universal as possible whereby the sliding door structure of the invention may be produced with a minimum inventory. At the same time, due to the single guiding fin provided in the head member 20 and the deletion of a separating fin between the fixed and movable door panels in the head 20, and the unique sealing members 88, 92 or 94, 122 and 126 provided, a more efficient and less expensive sealing system for the sliding door structure 10 than has been available in the past is provided.

Should the sliding door structure 10 shown in FIG. 1 be installed in areas where extremely high winds of for example hurricane velocity may be expected, a weather stop bracket 136, shaped as shown best in FIG. 6, is provided at the bottom of the free rail of the fixed door panel 14. In installation, the open end of the fixed door panel free side rail 34 is positioned over the rectangular portion 138 of the bracket 136 and positioned within the grooves 141 in the part 142 of bracket 136. A screw 140 is used to secure the bracket 136 to the sill 26.

In addition to the weather stop 136, the side rail 36 may, if considered necessary, be secured by a screw centrally thereof to the fin 100 of jamb 24, and the top rail 30 may be secured by a screw to the fin 80 of the head 20 adjacent the free side rail 34. With such additional structure, the sliding door structure 10 can withstand extremely high winds of hurricane velocity.

As shown best in FIG. 7, the upper corners of the sliding door structure 10 are provided with a weather stop and prowler security member 144. The member 144, which is shown in perspective in FIG. 8, includes the triangular fin portion 146 adapted to complete the guide fin 86 of the head 20. The fin 146 is necessary due to the mitered corner and the provision of the fin 86 on the head 20 without a similar fin on the jamb members 22 and 24.

In addition, the member 144 is provided with the rectangular portions 148 and 150 which extend across the pocket 112 in the jamp 22. The member 144 is spaced in the pocket 112 by the projections 152 and 154 thereon. The flanges 156 and 158 aid in retaining the member 144 in position at the top of the jamb members 22 and 24 with the upper portion of the fin 86 in the slot 160 between the portions 148 and 150. When installed on the head 20, member 144 also aids in the alignment of the mitered upper corners of frame 12 in field assembly of the frame.

In use, the member 144 also serves to prevent upward jiggling of the movable door panel 16 and consequent unlocking of the latching mechanism by prowlers or the like. Thus, with the movable door panel 16 closed, the top of the locking side rail 44 will engage the bottom side of the portions 148 and 150 to prevent undesired upward movement thereof.

A similar function may be accomplished by cut-out and folded-down rectangular portions such as portions 151 and 153 in the head 155 of the frame 157 shown in FIG. 14. Such cut-out and folded-down portions may be provided anywhere along the length of the head 157 where they are desired, but will most usually be spaced out across the opening provided in the sliding door structure by the open movable door panel.

A similar tab 149 may be cut and folded down from the head 155 adjacent the fixed door panel 270 as shown in FIG. 14. Tab 149 serves to retain the fixed panel in place in the frame 157 and takes wind load from the fixed door panel head extrusion.

Bumpers 164 as shown best in FIG. 7 are provided at the top and bottom of jamb 24 to prevent damage to the movable door panel 16, rollers secured thereto and/or the frame 12 due to rapid opening of the movable door panel 16 and/or cocking of the movable door panel 16 which might occur on engagement of the movable door panel with a single bumper 164 at either the head or sill of the frame 12. Thus, separate stop members 164 are positioned both on the rib 130 of the head and on the track 166 of the sill so that they engage the free rail 46 of the movable door panel 16 as the door panel approaches a fully open position. The bumpers 164 have the cross section illustrated in FIG. 7 and are provided with a slot 166 so that no fabrication of the head 20 or sill 26 is necessary to install the bumpers 164.

The triangular member 168 is provided at the bottom of the frame jambs 22 and 24 to close the bottom of the mitered jambs at the jamb fins 104. Fins 104 include the portion 105 which wraps around the top of a member 168 and fits within the offset 170 in the top of the triangular member 168 as shown in FIG. 9. Before being inserted in the ends of the fins 104 at the bottoms of the jamb members 22 and 24, the triangular members 168 may be secured in position on sill 26 by means of screws or the like, whereby the members 168 align the bottom mitered corners of the frame 12 in field assembly.

The glazing members 174 illustrated in FIGS. 1–3 can withstand high wind loads on the glazing panels 38 and 48. However, such channel type glazing is expensive and requires that the panels be removed and disassembled for reglazing. Therefore, since interior glazing of sliding doors is desirable, as for example in apartment buildings and the like, door panel top, bottom and side rails having a glazing cross section configuration such as that illustrated in FIG. 15 including the recess 176 are provided. Such rails in conjunction with the glazing members 180 and 182 or 184 illustrated in FIGS. 15 and 16 provide a very high wind resistant glazing system which may be installed from the inside of the sliding door and will accommodate substantially the full range of glazing panel thicknesses from thin, single strength to thicker insulating glazing panels at a moderate cost.

With the glazing system illustrated in FIG. 15, a glazing panel such as panel 186 is positioned in the door panel opening against the glazing flange 188. The glazing member 180 having the L-shaped cross section having the leg 190 and the leg 192 is positioned in the recess 176 with the leg 190 as shown within the recess. A glazing member 182 having a thickness depending on the thickness of the glazing panel 186, is inserted between the glazing panel 186 and the portion 192 of the glazing member 180 with the projection 194 on the member 180 extending within the recess 196 in the member 182. A glazing member 184 having the cross section whown in FIG. 16 may be used between member 180 and glazing panels 186 when the glazing panels are thick.

The modified glazing member 191 as shown in FIG. 17 is a dual durometer member having a relatively hard portion 193 similar to the L-shaped glazing member 180 and a relatively soft portion 195 similar to the glazing member 182. The portions 193 and 195 of the glazing member 191 are connected by the relatively soft, flexible portion 197. In installation, the L-shaped portion 193 of the glazing member 191 is installed in the recess 176 in the rails of a door panel and the portion 195 is rotated counterclockwise into the position shown for glazing member 182 in FIG. 15. The advantage of the dual durometer glazing member 191 is a saving in extrusion time, since only one extrusion need be made, and in cutting and assembly time, since only one glazing member 191 need be cut to length and handled.

The modified dual durometer glazing strip 199 illustrated in FIG. 18 may have a relatively hard, L-shaped portion 201 and the relatively soft portion 203 connected by a frangible portion 205. Alternatively, both portions 201 and 203 could be constructed of rigid vinyl or the like. In assembly of the glazing member 199, the L-shaped portion is positioned in recess 176 and the portion 203 is forced between the L-shaped portion 201 and the glazing panel 186.

To facilitate movement of the sliding door panel along the guide fin 86 without galling the guide fin 86 or causing objectionable noise due to metal to metal scraping between the movable door panel 16 and the guide fin 86, the moving panel top guide 200 as shown best in FIG. 10 is provided. The top guide 200 is provided with a hairpin shaped portion 202 which fits within a slot 204 in the upper end of the side rails 44 and 46 of the movable door panel 16 as shown in FIG. 3. The hairpin shaped portion 202 of the top guide 200 includes a slot 206 in which the guide fin 86 is slidably received and a flange 208 which aids in securing the member 200 in the slot 204. The top guide 200 is provided with the extension 210 having the spacing structure 212 on the ends thereof whereby with the top guide 200 in position at the ends of the top rail 40, the slot 206 is positioned centrally of the top rail.

A modified moving panel top guide 214 is illustrated in FIG. 11. The structure 214 is again provided with a hairpin portion 216 for receiving the fin 86 and adapted to be held within the slot 204. A flexible extension 218 is provided on one side of the hairpin portion 216 which engages the side of the guide fin 86 in assembly and prevents jiggling of the movable door panel 16 transverse of the door panel in operation.

With the larger size sliding doors today, it is unusual to find a building opening for a door which is exactly square. Thus, adjustment of the movable door panel 16 is normally required to provide a desired fit within the frame 12, the members of which are secured in the building opening and to some extent follow the irregularities of the building opening.

The structure shown in FIG. 12 provides adjustment of the moving door panel 16 by pivoting the moving door panel about the bottom of the locking rail on vertical adjustment of the free rail side thereof. The adjustment of the movable door panel 16 is accomplished through the use of expander 124, a wedge 236 adapted to fit within the expander 124, and a wedge block 238 secured within the side and bottom rails 46 and 42 of the door panel 16 in engagement with the wedge 236. In operation, the wedge 236 and the wedge block 238 provide an adjustment great enough so that the adjustment of only one side of the movable door panel 16 is normally required.

As shown, the wedge having the flanges 240 and 242 thereon fits within the expander 124 with the inclined plane portion 244 extending through the slot 246 therein and with the flanges 240 and 242 resting underneath and on top of the ribs 248 and 250 in the expander 124, respectively. The wedge block 238 shaped as shown best in FIG. 19 is secured to the side rail 46 by the screw 252 and extends within the bottom rail 42 with the inclined plane surface 254 in engagement with the inclined plane surface 244. The adjusting screw 256 extends through the slot 258 in the side rail 46 of the movable door panel 16.

Thus, in operation, on adjustment of the position of the wedge 236 longitudinally in the expander 124, the side rail 46 of the movable door panel 16 is adjusted vertically to pivot the door panel 16 in the plane thereof about the bottom of the locking side rail. The movable door panel 16 is thus adjusted relative to the expander 124 which carries the rollers 260 for the movable door panel 16 and carries the weather strip member 122 on the side thereof. The movable door panel 16 is thus adjusted to meet any out-of-squareness of the frame 12 without disturbing the rollers or the weather seal at the bottom of the door.

In addition, the use of the expander 124 permits exchange of the movable door panel 16 end for end to provide right and left hand operation by simply removing the expander 124 and the wedge block 238 and placing them in the other end of the movable door panel 16.

It will also be noted that the adjustment of the movable door panel 16 is accomplished with a minimum number of parts in the simplest manner without disturbing the weather tightness or structural integrity of the movable door panel while preserving the lack of specific orientation of the movable door panel.

To provide a three-step, coarse vertical adjustment for the movable door panel 16, the wedge 236 may be positioned with the flanges 240 or 242 on top of ribs 248 or with flanges 242 on top of ribs 250. Additional coarse adjustment could be provided by adding ribs intermediate ribs 248 and 250. In any position of wedge 236, fine adjustment of the edge of the door is accomplished by movement of the wedge 236 horizontally with respect to the wedge block 238 with the inclined plane portions 244 and 254 thereof in surface to surface engagement.

Adjustment of the other edge of the movable door panel 16 is possible with wedges and wedge blocks at both ends of expander 124.

Alternatively, the web 259 of rail 46 may be offset toward wedge 236 and used in place of wedge block 238 in conjunction with wedge 236 to provide adjustment of the edge of the movable door panel 16.

Another modification 262 of the sliding door structure of the invention illustrated best in FIGS. 13 and 14 is similar to the sliding door structure 10 and may in fact use an exterior frame 157 which is similar to the frame 12 of the sliding door structure 10 but may be of lighter and therefore more economical cross section. The head extrusion 155, jamb extrusions 264 and 266 and the sill extrusion 268 of the frame 157 are thus substantially the same as the head, jamb and sill members of the sliding door 10 as shown in FIG. 13 except for the previously considered tabs 151 and 152.

Similarly, the fixed and sliding panels 270 and 272 respectively are similar to door panels 14 and 16. The cross section of the rail members is however altered as shown in FIGS. 13 and 14 to provide a lighter, more economical and even more universal rail member. Thus, with the rail member cross sections illustrated in FIGS. 13 and 14, maximum strength per unit weight and maximum universality is provided to reduce inventory and thus cost of the sliding door structure.

As shown in FIGS. 13 and 14, the sliding door panels 270 and 272 utilize the dual member glazing system previously considered and illustrated in FIGS. 15–18 to secure the glazing panels 274 and 276 in the door panels. The sliding door structure 262 may utilize the mitered corner joints as illustrated in FIGS. 27–29, the weather seal and prowler protection structure and bumpers illustrated in FIG. 7, the weather seal structure illustrated in FIGS. 4 and 9, and the top guides of FIGS. 10 or 11, along with the adjusting structure for the movable door panel 272 as illustrated in FIG. 12.

In the sliding door structure illustrated in FIGS. 13 and 14, the fixed door panel 270 is secured in position by screws passing through the fins 278 of jamb 266 and fin 280 of head 155 in conjunction with an L-shaped bracket 282 secured between the fixed rail 284 of the fixed door panel 270 and sill 268 of the door structure 262. Additional screw 285 may be provided between the bottom rail 287 of door panel 270 and the sill 268 as desired as shown in FIG. 14.

The screen door structure 286 illustrated in detail in FIGS. 19–25 has also been particularly designed for economy and efficiency of operation in conjunction with the sliding door structure 262 but is equally as economical and efficient in use with other sliding door structures such as sliding door structure 10.

As shown in FIG. 19, the screen door structure 286 includes a frame 288 having top and bottom rails 290 and 292 and side rails 294 and 296. The screen rails have a cross section as shown best in FIG. 20 including a first rectangular portion 298 and a second rectangular portion 300 separated by a web portion 302. The rectangular portion 298 has a width transverse of the screen door structure 286 greater than that of the rectangular portion 300, which rectangular portion 300 has an open outer side 304.

Also, the cross section of the screen rails as shown in FIG. 20 includes an integral portion 306 in the shape of a parallelogram having one open side 308 which forms a recess in which the edge of the screen member 310 is secured by an H-shaped spline 312 having outer dimensions which define a parallelogram similar to the recess 314. The integral parallelogram structure and the spline securing the periphery of the screen member 310 to the frame 288 is illustrated best in FIG. 21.

Such frame cross section is easily extruded and adapts itself to being connected with a pair of corner brackets 316 and 318 at each corner thereof whereby the frame 288 is particularly stiff. Such frame cross section also eliminates the necessity for separate handle structure for opening and closing the screen since the screen can be moved by placing the fingers in the recesses formed on either side of the web portion 302 of the cross section and applying pressure against either portion 298 or 300 depending on the direction of movement of the screen door 286 that is desired.

The cross section of the rail members of the frame 288 further permits the use of a relatively simple locking structure 320 with the screen door 286. The locking structure 320 includes a bushing 322, a locking member 324 having camming beads 321 thereon positioned adjacent one end of the bushing 322 and pivotally secured thereto by a pivot bolt 326. The pivot bolt 326 extends through the locking member 324, the bushing 322 and the jamb 264 of the sliding door structure 262. Thus, pivoting of the locking member 324 into and out of the recess provided between the rectangular portions 298 and 300 of the rail cross sections locks and unlocks the screen door 286 in a closed position.

Spring biased adjustable roller assemblies 325 are provided in all four corners of the screen door structure 286 to adjust the screen door to sliding door frames which are not exactly square. One adjusting assembly 325 is shown in detail in FIGS. 22–25. The adjusting assembly 325 includes the biasing spring 332, an adjustable roller assembly 334, and an adjusting wedge 336.

Figure 25:
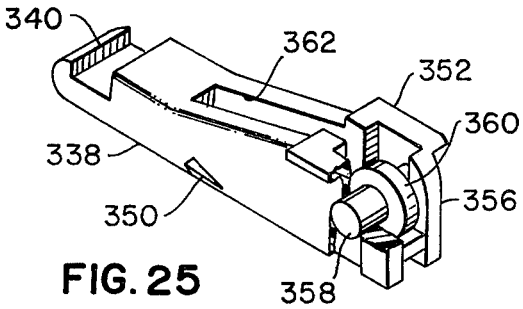
FIG. 25 is a partly broken away, perspective view of the roller assembly of the spring loaded roller assembly illustrated in FIGS. 22 and 23.

As shown best in FIG. 25, the adjustable roller assembly 334 includes a roller housing 338 having a hook 340 at one end thereof which is pivotally engageable with a corresponding hook portion 342 on a corner bracket 316 to provide pivoting of the adjustable roller assembly 334 about the point 344 under urging of the bias spring 332. Bias spring 332 is positioned over spring retention pin 333 in roller housing 338 which pin holds the spring in position for ease of installation of the spring and roller assembly.

Figure 22:
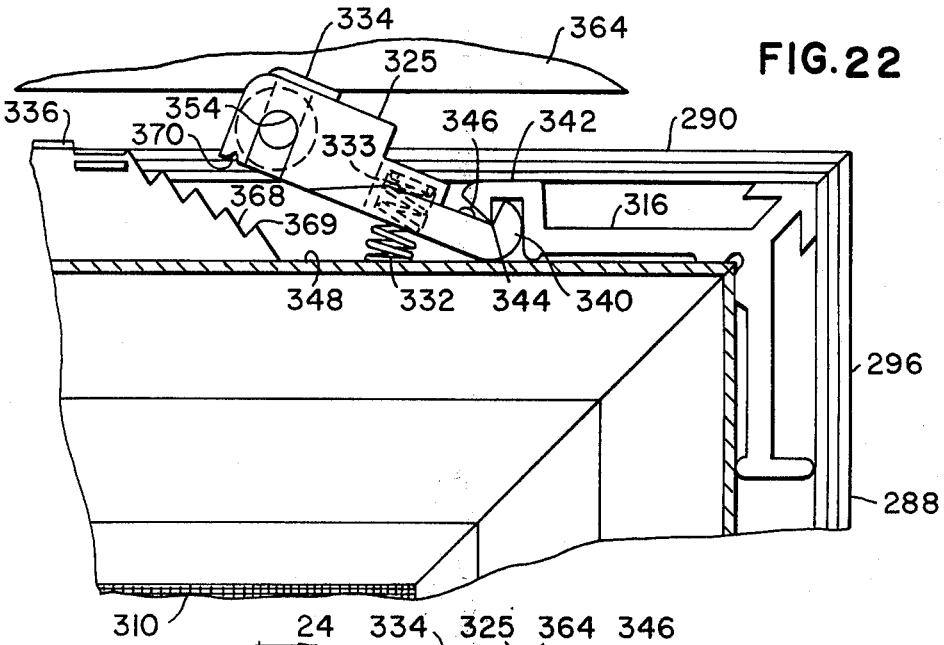
FIG. 22 is an enlarged, partly broken away, elevation view of a corner of the screen door structure illustrated in FIG. 19, showing one of the spring loaded, adjustable roller assemblies at the four corners thereof in one adjusted position thereof.
Figure 23:
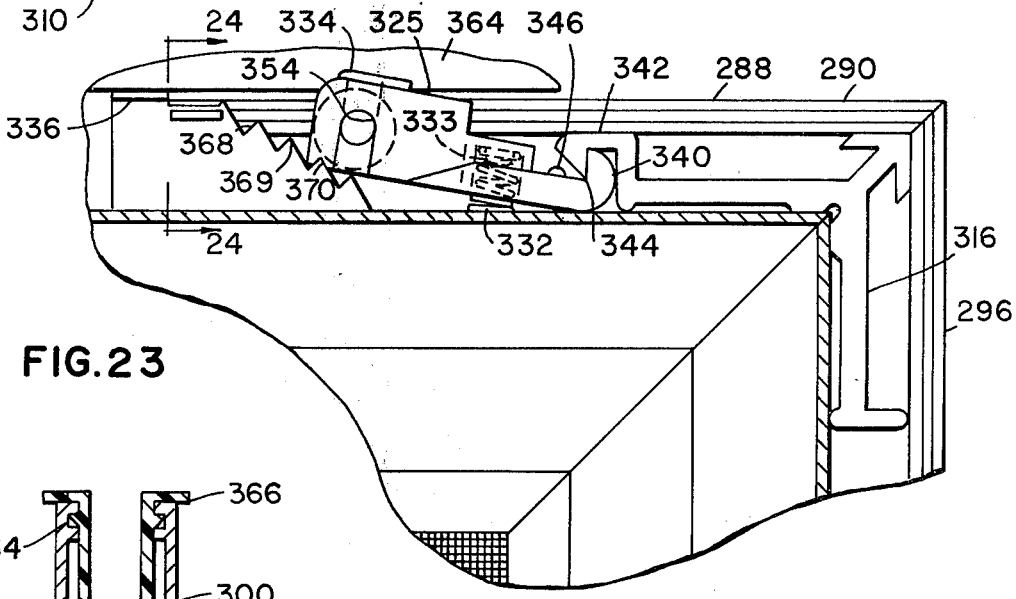
FIG. 23 is a view similar to FIG. 22, showing the spring loaded, adjustable roller assembly in an alternate adjusted position thereof.
Figure 24:
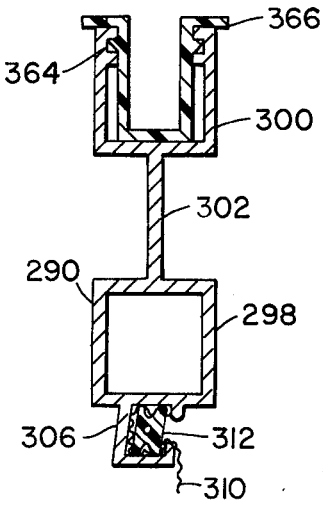
FIG. 24 is an enlarged, partial section view of the screen door structure illustrated in FIG. 19, taken substantially on the line 24—24 of FIG. 23.

In the roller assembly 334 illustrated in FIG. 22, a hemispherical abutment 346 is provided on the roller housing 338 to limit pivotal movement of the roller assembly 334 out of the recess 348 provided in portion 300 of the top rail 290. In the modification of the adjustable roller assembly 334 illustrated in FIG. 25, the pivotal movement is limited by the abutments 350 on the sides of the roller housing 338. In either case, the pivoting of the adjustable roller assembly 334 into the recess 348 is limited by the flanges 352 on the bifurcated end of the roller housing 338.

Openings 354 are provided in the bifurcated end 356 of the roller housing 338 for receiving the integral axle portions 358 of the roller 360 whereby the roller 360 is secured in the roller housing 338 in alignment with the slot 362 therein produced by the bifurcation of the end 356 thereof. The track 364 of the frame head extrusion 157 is received in the slot 362 of the adjustable roller assemblies 334 in the top rail 290 of the screen 268, while the track 366 is received in the slot 362 in the adjustable roller assemblies in the bottom rail of the screen 286.

The pivotally adjusted position of the adjustable roller assembly 334 is also limited with respect to movement inward of the recess 348 by the adjusting wedge members 336 slidable along the top and bottom rails of the screen 286 within the recesses 348. As shown best in FIG. 24, the adjusting wedge members 336 include the guide flanges 364 and the adjusting flanges 366 by which the wedge members are guided and moved respectively in the recesses 348. Further, the wedge members 336 are provided with notches 368 on inclined camming surfaces adjacent the adjustable roller assemblies 334, which notches provide points 369 for successively engaging a notch 370 in the roller housing 338 of the adjustable roller assemblies on movement of the wedge members 336 toward or away from the adjustable roller assemblies.

With such spring biased adjustable roller assemblies, the actual roller 360 may be relatively small so that the open depth of the top and bottom rails need not be large, whereby a relatively strong frame may be produced with a minimum of material by a simple extrusion cross section.

In four-panel sliding door installations, a portion of one of which is illustrated in FIG. 26, an astragal adapter 372 having the general cross section illustrated in FIG. 26 and extending substantially the full length of the locking rails 375 and 377 of the two movable door panels in such four-panel door installations is secured to one of the locking rails by convenient means such as screws and releasably receives the locking rail of the other of the movable door panels. Conventional handle and locking structures may be secured to the abutting locking rails and/or astragal adapter.

With such structure, one of the usual two sliding screen doors 286 is provided with an L-shaped base bracket 374 secured to one of the abutting locking rails 238. A bushing 376 is positioned with one end against the bracket 374. A locking member 378 is positioned against the other end of the bushing and is pivotally secured to the other end of the bushing by means of the pivot bolt 380 extending through the locking member 378, the bushing 376 and the base bracket 374. An astragal adapter 379 is provided between the abutting locking rails 238 of screen doors 386 in the four-panel installation. Astragal adapter 379 has the cross section shown in FIG. 26 and extends substantially the full length of screen doors 286.

Three-panel sliding door installation are also possible as shown in FIG. 27. In the three-panel sliding door installations, an astragal adapter 381 having the cross section shown is secured to the free rail of a fixed door panel and receives the locking rail of a movable door panel.

With the sliding door structures 10 and 262, it is often desirable to double lock the movable door panel or open it a few inches to provide ventilation and still maintain the movable door panel locked to prevent entry of prowlers or the like or to prevent small children from going out of the sliding door. As indicated above, in the past such locks have not been provided on sliding door structure or have either been too complicated or not sufficiently sophisticated. Thus, in the past a length of pipe which may be inserted between the frame jamb and the free rail of the movable door panel of the sliding door structures has been used to prevent opening of the movable door panel more than a predetermined amount.

In accordance with the present invention, a prowler lock structure 384 is provided as shown in FIG. 31 which includes a generally V-shaped member 386 having a notch 388 at the end of one leg thereof, a template opening 390 adjacent the apex thereof and an opening 392 in the apex thereof in which a stud 394 is secured extending on both sides of the member 386. The stud 394 has enlarged headed portions 396 on the ends thereof. The prowler lock structure 384 has the elevation configuration illustrated in FIG. 31 and is substantially flat except for the stud extending therethrough as shown in FIG. 32.

On installation, the prowler lock member 386 is positioned with the top of one side of the movable door panel free side rail received in the notch 388. The notch 388 and the relative dimensions of the prowler lock member 386 together with the positioning of the movable door side rail in relation to the head of the sliding door frame is such that after installation, the prowler lock member 386 cannot be removed from the moving panel side rail without adjusting the movable panel to its lowermost position.

After installation of the prowler lock member 386 on the side rail, the prowler lock member 386 is pivoted counterclockwise about the top of the side rail portion within the notch 388 until the stud 394 on the prowler lock member 386 engages the fin of the frame head member, at which time a hole 398 is drilled through the template opening 390 in the adjacent fin of the head member. Such holes are drilled wherever it is desired to lock the movable door panel.

In operation then, with the holes 398 drilled in the head fin and with the prowler lock member 386 positioned as indicated in FIG. 31, the movable door panel may be completely opened and closed with the prowler lock member 386 serving no function. When it is desired to lock the movable door panel in a position at which there is a hole 398, the prowler lock member 386 is pivoted counterclockwise so that the stud 394 aligns with the desired hole 398, after which the prowler lock member 386 is moved transversely outwardly of the sliding door structure to engage one end of the stud 394 in the selected hole 398. The other end of the stud 394 may be used as a handle in accomplishing the alignment and movement of the prowler lock member 386. On release of the prowler lock member 386, the head portion 396 on the end of the stud 394 within the hole 398 will prevent accidental removal of the stud from the hole and provide a positive lock of the sliding door panel in the selected position.

In the modified prowler lock structure 400 illustrated in FIG. 33, the prowler lock member 402 has a side elevation as shown and again is generally flat except for a stud 404 extending transversely therethrough, which stud may have a head 406 on the side adjacent the fin of the sliding door frame head and may have a nut 408 associated therewith which would serve as a handle on the opposite side thereof, as shown in FIG. 34.

With the prowler lock structure 400 illustrated in FIGS. 33 and 34, again the prowler lock member 402 is positioned over the end of the side rail by means of the slot 410 in which position the prowler lock member 402 may be moved up or down, as desired. Again, an opening through the prowler lock member 402 (not shown) may be used as a template for drilling holes 412 in the flange of the frame head at the locations where locking is required.

In operation, with the prowler lock member 402 in a down position, the prowler lock structure is not operative. When it is desired to lock the movable door panel in a selected position, the movable door panel is moved to the position desired, the prowler lock member 402 is moved up and the stud 404 is aligned with an opening 412, after which the prowler lock member is moved toward the fin of the frame head to insert the stud 404 through the selected hole 412 and provide a positive lock for the movable door panel.

A third prowler lock structure 414 suitable for use with the sliding door structures 10 and 262 and illustrated in FIG. 30 includes the prowler lock lever 416 including the notch 425 therein adapted to receive the upper end of the moving panel free side rail. Lever 416 further has a projection 418 on the end 420 thereof adapted to fit within openings 422 provided in the sliding door frame head. The end 424 of the prowler lock lever 416 is weighted to bias the projection 418 into an opening 422 in the head. A further notch 426 is provided in lever 416 which is also adapted to fit over the top of the free side rail of the sliding door moving panel and thus retain the lever 416 in a stored position with the end 418 not biased into engagement with the sliding door frame head as shown in phantom in FIG. 30.

Thus, in operation of the prowler lock structure 414, with the top of the rail within notch 426 in lever 416, the movable door panel 16 may be moved to any desired location. With the top of the free rail of the sliding door panel in the notch 425 in lever 416, the projection 418 of the lever 416 will be biased into the first opening 422 in the frame head that it comes to on sliding of the movable door panel in either direction to positively lock the movable door panel in a desired position.

In the prowler lock structure 450 illustrated in FIG. 35, a member 452 having the elevation illustrated in FIG. 35 and a width suitable for fitting within the frame head of the sliding door structure over the movable door panel is secured to the head of the frame adjacent the free end of the movable door panel by convenient means such as screws (not shown). A flexible spring member 456 having the configuration shown in FIG. 35 is positioned in the recess 458 and the locking member 460 is hooked over the rib 462 by means of the hooked end 464 thereof whereby the end 466 thereof will engage the free side rail of the movable door panel and prevent undesired opening movement thereof.

When it is desired to open the movable door panel, the lock member 460 may be pivoted clockwise by insertion of a finger in the recess 468 after which the locked member 460 may be moved to the right in FIG. 35 whereby the spring 456 maintains it in a horizontal position out of the way of the movable door panel. A reverse process may be used to move the lock member 460 into a locking position.

If desired, the ventilation stop 474 may be secured at the other end of the member 452 by the interlocking hook portions 476 and 478 thereon. In operation, the ventilation stop member 474 permits opening of the movable door panel only a desired amount as, for example, six inches, to prevent entry of prowlers and undesired exit of small children, and the like.

As shown best in FIG. 36, the frames 12 and 157 of sliding door structures 10 and 262 may be secured in a building opening 480 by means of nails passed through nailing strip adapters 482 interlocked with a rib 485 on the frame members where direct connection of the frame members in the building opening is not desired. The nailing strip 482 has the cross section illustrated in FIG. 36 and may be of any desired length. Alternate nailing strips 484 particularly suitable for use with brick construction may have the configuration shown in FIG. 37. Such nailing strips may be attached to the door frame by convenient means such as by screws, as shown, or by staking. Staking as at 524 is desirable especially when the nailing strips are plastic or metal and installed by sliding onto the door frame as shown in FIG. 41.

Further, the interior trim of the building opening 480 may be facilitated with a trim extrusion 486 having the cross section illustrated in FIG. 36. While other building constructions are possible, in FIG. 36 brick facing 488, interior stud 490, exterior wall 492 and interior wall 494 are illustrated. The joint between the frame jamb and the interior trim extrusion 486 is closed as shown by the trim extrusion extending under the frame jamb. The trim extrusion 486 is provided with break-off grooves 494 to accommodate different wall thicknesses.

Also, the interior trim of the building opening in which the sliding door structure is secured may be facilitated at the sill by means of the plastic bullnose extrusion 496 having the cross section shown in FIG. 38 and adapted to fit between the inner sill flange and the interior flooring 498. The bullnose extrusion 496 is flexible to permit varying dimensions of flooring to be used in conjunction with a standard sill.

A modification of the bullnose member 496 is shown in FIG. 39 to accommodate thicker flooring such as carpeting as may be desired or to accommodate a lower inner flange on the frame sill. To this end, the extension 500 is provided on the bullnose interior trim member 502 illustrated in FIG. 39.

Further, the sill may be extended by means of the adapter extrusion 504 having the cross section illustrated in FIG. 38 and shown in conjunction with wood sub-flooring and masonry exterior building members 506 and 508.

The exterior trim member 510 illustrated in FIG. 40 is unique in that it includes a relatively soft wood core 512 and an extruded shell 513 of relatively harder and/or more weather resistant material adapted to interlock with the sliding door frame as shown in conjunction with the frame jamb. The trim member 510 may be secured to the usual exterior wood building wall by convenient means such as nails (not shown).

Interior trim may assume the configuration of extrusion 514 having the cross section shown in FIG. 40 including the pocket 516 for receiving the end 518 of the frame jamb cross section and the flexible leg portions 520 and 522. Assembly of the interior trim strip 514 is as shown in FIG. 40.

While one embodiment of the present invention and several modifications thereof have been disclosed in detail, it will be understood that other embodiments and modifications of the invention are contemplated. It is the intention to include all embodiments and modifications as are defined by the appended claims within the scope of the invention.

What I claim as my invention is:

1. Sliding closure structure comprising an outer frame having a head, jambs and a sill, at least one movable closure panel having top, side and bottom rails in assembly with the outer frame for sliding movement therein between the jambs of the outer frame, and prowler lock means connected between the movable closure panel and frame including a retaining member for the locking member secured to the frame head member, a loose locking member positioned on one of and operably positionable between both of the frame and closure panel so as to abut both the frame and closure panel but not fastened to either the frame or closure panel, which locking member is an elongated member having means engaging the retaining member at one end thereof to permit pivoting of the locking member into an abutting position with regard to the closure panel in one relative position of the locking member and the retaining member, and means operably associated with the locking member for moving the locking member into a storage position wherein the closure member is permitted free sliding movement in the frame and a locking position wherein the closure member is fixed in at least one position, and spring means for securing the locking member between the retaining member and the frame head member in a second pivoted position thereof wherein the locking member will not engage the closure panel as it is moved within the frame.

2. Structure as set forth in claim 1 and further including a positive closure panel stop secured to the retainer member for limiting the relative movement between the closure panel and frame.

* * * * *